US007603985B2

(12) United States Patent
Nagasaka et al.

(10) Patent No.: US 7,603,985 B2
(45) Date of Patent: Oct. 20, 2009

(54) COMMON RAIL

(75) Inventors: Tomoaki Nagasaka, Okazaki (JP); Hiroyuki Yokoya, Anjo (JP)

(73) Assignee: Denso Corporation, Kariya (JP)

( * ) Notice: Subject to any disclaimer, the term of this patent is extended or adjusted under 35 U.S.C. 154(b) by 108 days.

(21) Appl. No.: 12/014,144

(22) Filed: Jan. 15, 2008

(65) Prior Publication Data

US 2008/0178457 A1 Jul. 31, 2008

(30) Foreign Application Priority Data

Jan. 25, 2007 (JP) ..... 2007-015354
Jul. 25, 2007 (JP) ..... 2007-193661

(51) Int. Cl.
*F02M 69/46* (2006.01)

(52) U.S. Cl. ..... 123/456; 123/468

(58) Field of Classification Search ..... 123/456, 123/468, 469

See application file for complete search history.

(56) References Cited

U.S. PATENT DOCUMENTS

| | | | | |
|---|---|---|---|---|
| 4,577,593 | A * | 3/1986 | Teigen | 122/235.15 |
| 6,283,733 | B1 * | 9/2001 | Merklein et al. | 417/549 |
| 6,463,909 | B2 * | 10/2002 | Asada et al. | 123/456 |
| 6,491,439 | B1 * | 12/2002 | Zimmer | 384/295 |
| 6,929,288 | B2 * | 8/2005 | Usui | 285/192 |
| 6,981,722 | B2 * | 1/2006 | Watanabe | 285/353 |
| 7,216,631 | B2 * | 5/2007 | Nishiwaki et al. | 123/467 |
| 7,461,636 | B2 * | 12/2008 | Ricco et al. | 123/456 |
| 7,487,759 | B2 * | 2/2009 | Ochiai | 123/469 |
| 7,516,734 | B2 * | 4/2009 | Tominaga et al. | 123/456 |
| 2004/0089832 | A1 * | 5/2004 | Wilde et al. | 251/129.15 |
| 2005/0082823 | A1 * | 4/2005 | Neumaier | 285/110 |
| 2005/0200124 | A1 * | 9/2005 | Kleefisch et al. | 285/290.1 |
| 2007/0006848 | A1 * | 1/2007 | Ricco et al. | 123/456 |
| 2007/0169751 | A1 | 7/2007 | Tominaga et al. | |
| 2008/0035761 | A1 | 2/2008 | Akabane | |

FOREIGN PATENT DOCUMENTS

| | | |
|---|---|---|
| JP | 2002-322965 | 11/2002 |
| JP | 2004-36441 | 2/2004 |
| JP | 2006-9754 | 1/2006 |

OTHER PUBLICATIONS

Japanese Office Action dated Jan. 27, 2009 issued in corresponding Japanese Application No. 2007-193661, with English translation.

* cited by examiner

*Primary Examiner*—Thomas N Moulis
(74) *Attorney, Agent, or Firm*—Nixon & Vanderhye, P.C.

(57) ABSTRACT

A small-diameter circular column portion having a diameter slightly smaller than that of a small-diameter hole (press-fitting hole) of an inside-outside communication hole is formed at a press-fitting end portion of a bush. A narrow annular clearance is formed between the small-diameter circular column portion and the small-diameter hole when the bush is press-fitted. Even if a press-fitting burr is produced at the press-fitting end portion during manufacturing of a common rail, the press-fitting burr is confined in the depth of the annular clearance. Even when fuel flows through the inside-outside communication hole during engine operation, movement of the fuel and the fuel flow acting on the press-fitting burr are limited in the depth of the annular clearance, inhibiting the press-fitting burr from dropping out or flowing out. Thus, a highly reliable common rail can be provided at low cost.

11 Claims, 8 Drawing Sheets

COMMON RAIL

CROSS REFERENCE TO RELATED APPLICATION

This application is based on and incorporates herein by reference Japanese Patent Application No. 2007-15354 filed on Jan. 25, 2007 and Japanese Patent Application No. 2007-193661 filed on Jul. 25, 2007.

BACKGROUND OF THE INVENTION

1. Field of the Invention

The present invention relates to a common rail that is mounted to a pressure accumulation fuel injection system and accumulates high-pressure fuel.

2. Description of Related Art

A common rail 101 of a related art will be described with reference to FIG. 14. The common rail 101 is a pressure accumulator for accumulating high-pressure fuel pumped from a high-pressure fuel pump (supply pump or the like) and has an accumulation chamber (central hole) 123 formed therein for accumulating the high-pressure fuel therein. The common rail 101 has pipe joints 121 to be connected with external pipes (a high-pressure pump pipe, an injector pipe, and the like). A center portion of an outer end of the pipe joint 121 communicates with the accumulation chamber 123 through an inside-outside communication hole 124 (branch hole).

An orifice 130 for reducing pressure pulsation caused by an injection operation of an injector or an orifice 130 for reducing pressure pulsation caused by pumping operation of the high-pressure fuel pump is formed in the inside-outside connection hole 124. The orifice 130 of the related art is formed by directly drilling a main body 120 (hereinafter referred to as a rail main body) of the common rail 101. The orifice 130 is formed in the deepest portion of the inside-outside connection opening 124 because of constraints concerning the drilling. That is, as shown in FIG. 14, the orifice 130 opens in the accumulation chamber 123.

High-pressure fuel is accumulated in the accumulation chamber 123 and therefore high pressure is applied to the inner peripheral surface of the accumulation chamber 123. The orifice 130 having a small diameter opens in and crosses the inner peripheral surface of the accumulation chamber 123. A portion of the opening that crosses the inner peripheral surface is hereinafter referred to as a crossing hole. As the crossing hole becomes smaller, a larger stress is concentrated at the edge of the opening of the crossing hole. Therefore, a common rail, in which the orifice 130 is integrally formed in the rail main body 120 by the drilling, is used for a pressure accumulation fuel injection system of a small size vehicle or the like, in which accumulation pressure of the accumulation chamber 23 is comparatively low (for example, 180 MPa or under).

In recent years, it has been required to increase the common rail pressure to 180 MPa or over also in the small size vehicle for the purpose of improving exhaust performance and the like. However, a common rail having the orifice 130 integrally formed in the rail main body 120 by the drilling has the small crossing hole, which is formed by the orifice 130, and therefore has difficulty in securing a safety factor concerning fatigue strength. Therefore, not only in a large size vehicle but also in the small sized vehicle, for the purpose of securing the safety factor concerning the fatigue strength, as shown in FIG. 3, there has been proposed a common rail 1, in which an orifice 30 is formed in a bush 31 separate from a rail main body 20 and the bush 31 is fixed in an inside-outside communication hole 24 to enlarge the crossing hole (for example, as described in Patent document 1: JP-A-2002-322965) in place of forming the orifice 130 directly in the rail main body 120.

A technology of the related art that fixes the bush 31 having the orifice 30 in the inside-outside communication hole 24 press-fits an outer peripheral surface of the bush 31 into the inside-outside communication hole 24. When the bush 31 is inserted into the inside-outside communication hole 24, there is a possibility that a press-fitting burr A is produced at an end portion (hereinafter referred to as a press-fitting end portion) of the bush 31 opposite to the press-fitting direction of the bush 31 as shown in FIG. 4A.

When the engine is driven in a state where the press-fitting burr A is produced as shown in FIG. 4A, there is a possibility that the press-fitting burr A is dropped by an action of the flow of the fuel and flows as a foreign matter to the injector. When the press-fitting burr A is dropped and flows to the injector, the press-fitting burr A clogs a filter disposed in the injector. When a small press-fitting burr A passes through the mesh of the filter of the injector, there is a possibility that the burr A enters the injector having high accuracy and causes malfunctions such as faulty sliding and faulty sealing.

SUMMARY OF THE INVENTION

It is an object of the present invention to provide a common rail capable of avoiding a malfunction caused by a press-fitting burr.

According to an aspect of the invention, a bush is pressed-fitted in an inside-outside communication hole of a common rail. A clearance (press-fitting burr release portion) is formed between an outer peripheral surface of a press-fitting end portion of the bush and an inner peripheral surface of the inside-outside communication hole in a state where the bush is press-fitted in the inside-outside communication hole. Thus, even if the press-fitting burr is produced at the press-fitting end portion of the bush by the press-fitting operation, the press-fitting burr is confined in the clearance. Even when the fuel flows through the inside-outside communication hole during operation of an engine, the movement of the fuel in the clearance is limited and therefore the flow of the fuel acting on the press-fitting burr is small. As a result, the press-fitting burr can be prevented from dropping out.

Thus, even if the press-fitting burr is produced at the press-fitting end portion of the bush, the press-fitting burr can be prevented from dropping out. Accordingly, necessity for work of removing the press-fitting burr and management of presence or absence of the press-fitting burr, which require a lot of labor, can be eliminated. As a result, a highly reliable common rail can be provided at low cost.

According to another aspect of the invention, the common rail has a lid portion formed at the press-fitting end portion of the bush for confining the burr in the clearance. Thus, even if the press-fitting burr drops, the dropped press-fitting burr is confined in the clearance with the lid portion. Accordingly, the dropped press-fitting burr is prevented from flowing out to the injector.

According to yet another aspect of the invention, in the common rail, the bush is fixed in the inside-outside communication hole by plastically deforming the bush in a state where the bush is inserted in the inside-outside communication hole. Accordingly, the press-fitting burr is not produced at the bush. Since the press-fitting burr is not produced by the fixation of the bush, the necessity for the work of removing the press-fitting burr and the management of the presence or absence of the press-fitting burr, which require a lot of labor, can be eliminated. As a result, a highly reliable common rail can be provided at low cost.

BRIEF DESCRIPTION OF THE DRAWINGS

Features and advantages of embodiments will be appreciated, as well as methods of operation and the function of the related parts, from a study of the following detailed description, the appended claims, and the drawings, all of which form a part of this application. In the drawings:

DETAILED DESCRIPTION OF EXAMPLE EMBODIMENTS

Figure 1:
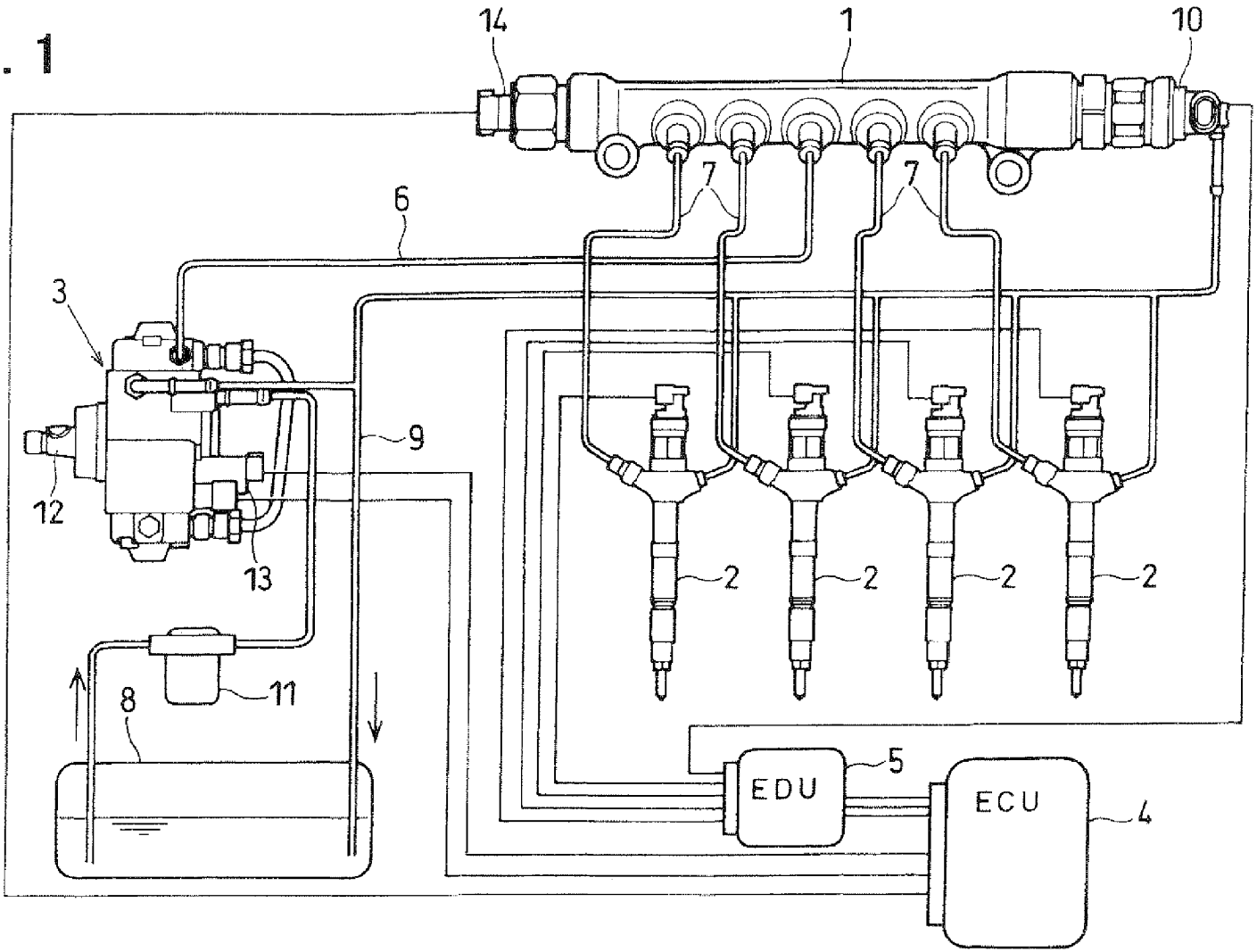
FIG. 1 is a system construction diagram showing a pressure accumulation fuel injection system according to a first embodiment of the present invention.

Referring to FIG. 1, a system construction of a pressure accumulation fuel injection system according to a first embodiment of the present invention is illustrated. The pressure accumulation fuel injection system shown in FIG. 1 is a system for injecting fuel into respective cylinders of an engine (for example, diesel engine: not shown). The system includes a common rail 1 injectors 2, a supply pump 3, an ECU 4 (engine control unit), an EDU 5 (drive unit), and the like. The EDU 5 may be installed in a casing of the ECU 4.

The common rail 1 is an accumulator for accumulating high-pressure fuel to be supplied to the injectors 2. In order to accumulate high-pressure fuel at a common rail pressure corresponding to a fuel injection pressure, the common rail 1 is connected to a discharge hole of the supply pump 3 that pumps the high-pressure fuel through a high-pressure pump pipe 6. The common rail 1 is connected with multiple injector pipes 7 for supplying the high-pressure fuel to the respective injectors 2.

A pressure reduction valve 10 serving also as a pressure limiter is attached to a relief pipe 9 for returning the fuel from the common rail 1 to a fuel tank 8. The pressure limiter functions as a pressure safety valve. When the common rail pressure exceeds a limit set pressure, the pressure limiter opens to suppress the common rail pressure to the limit set pressure or under. The pressure reduction valve 10 opens in response to an instruction from the ECU 4 and the EDU 5 to reduce the common rail pressure quickly. A pressure limiter may be mounted independently and separately from the pressure reduction valve 10.

The injectors 2 are mounted in the respective cylinders of the engine for injecting and supplying the fuel into the cylinders. The injectors 2 are connected to downstream ends of the multiple injector pipes 7 branching from the common rail 1. Each injector 2 has a fuel injection nozzle that injects and supplies the high-pressure fuel accumulated in the common rail 1 into each cylinder, an electromagnetic valve that performs lift control of a needle valve received in the fuel injection nozzle and the like. The fuel leaking from the injectors 2 is also returned to the fuel tank 8 through the relief pipe 9.

The supply pump 3 is a high-pressure fuel pump for pumping the high-pressure fuel to the common rail 1. The supply pump 3 has a feed pump that suctions the fuel from the fuel tank 8 to the supply pump 3 via a fuel filter 11 and a high-pressure pump that pressurizes the fuel suctioned by the feed pump to high pressure and pumps the high-pressure fuel to the common rail 1. The feed pump and the high-pressure pump are driven by a common camshaft 12. The camshaft 12 is rotated and driven by the engine.

The supply pump 3 includes a fuel passage therein for leading the fuel into a pressurizing chamber for pressurizing the fuel to the high pressure and a SCV 13 (suction control valve) in the fuel passage for controlling an opening degree of the fuel passage. The SCV 13 is controlled by a pump drive signal from the ECU 4. Thus, the SCV 13 controls a suction quantity of the fuel suctioned into the pressurizing chamber to change a discharge quantity of the fuel pumped to the common rail 1. Thus, the SCV 13 controls the common rail pressure by controlling the discharge quantity of the fuel pumped to the common rail 1. That is, the ECU 4 controls the SCV 13 to control the common rail pressure to pressure corresponding to a driving state of a vehicle.

The ECU 4 has a CPU and storage devices (memories such as ROM, RAM, SRAM, and EEPROM). The ECU 4 performs various types of arithmetic processing based on programs stored in the ROM and signals of sensors (i.e., the driving state of the vehicle) read into the RAM and the like. In an example of the arithmetic processing, the ECU 4 determines a target injection quantity, an injection mode, valve opening/closing timing of the injector 2 and the opening degree of the SCV 13 (energization current value) for each cylinder based on the programs stored in the ROM and the sensor signals (i.e., the driving state of the vehicle) read into the RAM.

The EDU 5 includes an injector drive circuit. The injector drive circuit supplies a valve opening drive current to the electromagnetic valve of the injector 2 and the like based on an injector valve opening signal supplied from the ECU 4. The high-pressure fuel is injected and supplied into the cylinder by supplying the valve opening drive current to the electromagnetic valve and the fuel injection is stopped by stopping the valve opening drive current. FIG. 1 shows an example, in which a SCV drive circuit for supplying the driving current to the electromagnetic valve of the SCV 13 is located in the casing of the ECU 4. Alternatively, the SCV drive circuit may be located in the casing of the EDU 5.

The ECU 4 is connected with sensors as means for sensing the driving state of the vehicle and the like such as a pressure sensor 14 for sensing the common rail pressure, an accelerator sensor for sensing an accelerator position, a rotation speed sensor for sensing engine rotation speed, and a coolant temperature sensor for sensing coolant temperature of the engine.

Figure 2:
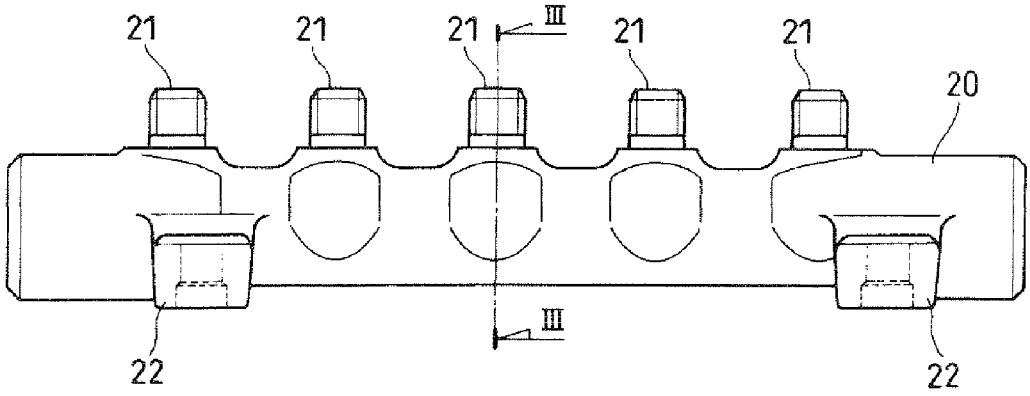
FIG. 2 is a side view showing a common rail according to the first embodiment.

Then, the structure of the common rail 1 will be described with reference to FIGS. 2 to 4B. As shown in FIG. 2, the common rail 1 according to the present embodiment consists of a rail main body 20 formed substantially in a cylindrical shape for accumulating ultra-high pressure fuel inside, pipe joints 21 provided to the rail main body 20 to be connected with the high-pressure pump pipe 6 and the injector pipes 7 (hereinafter referred to as the pipes 6, 7) and stays 22 provided to the rail main body 20 for mounting the rail main body 20 to a fixation part of the engine or the like.

Figure 3:
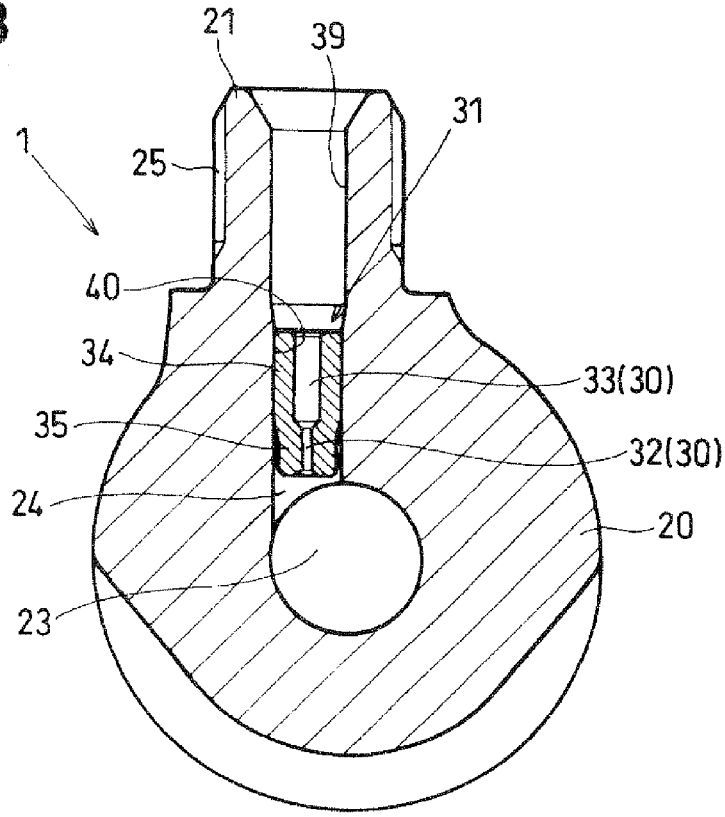
FIG. 3 is a sectional view showing the common rail of FIG. 2 taken along the line III-III.

The rail main body 20 is formed substantially in the shape of a rod and is made of an iron family metal. As shown in FIG. 3, an accumulation chamber 23 for accumulating the high-pressure fuel is formed substantially in the central portion of the rail main body 20 such that the accumulation chamber 23 extends in an axial direction of the rail main body 20. The axial center of the accumulation chamber 23 may coincide with the center of the external diameter of the rail main body 20 as shown in FIG. 3. Alternatively, the axial center of the accumulation chamber 23 may be offset from the center of the external diameter of the rail main body 20 by a specific distance.

Multiple inside-outside communication holes 24 are formed in the rail main body 20 in the radial direction of the rail main body 20. The pipe joints 21 are arranged at suitable intervals of the axial direction of the rail main body 20. Each inside-outside communication hole 24 is drilled in the center of each pipe joint 21. An inner end of the inside-outside communication hole 24 opens in an inner wall surface of the accumulation chamber 23. An outer end of the inside-outside communication hole 24 opens in the central portion of the tip of the pipe joint 21. A pressure receiving seat surface substantially in the shape of a counter-tapered circular cone is formed on the tip surface of each pipe joint 21. A dwindling tapered surface formed at the tip of each of the pipes 6, 7 is inserted to the pressure receiving seat surface. The outer end of each inside-outside communication hole 24 opens in the bottom of the pressure receiving seat surface. An external thread 25 for fastening a pipe nut disposed at a connection end of each of the pipes 6, 7 is formed on the outer peripheral surface of each pipe joint 21.

The high-pressure fuel is accumulated in the accumulation chamber 23 and therefore high pressure is applied to the inner peripheral surface of the accumulation chamber 23. Thus, stress is concentrated at an edge of a crossing hole of the inside-outside communication hole 24 that opens in the inner peripheral surface of the accumulation chamber 23. The stress applied to the edge of the crossing hole increases as the diameter of the crossing hole decreases.

Figure 14:
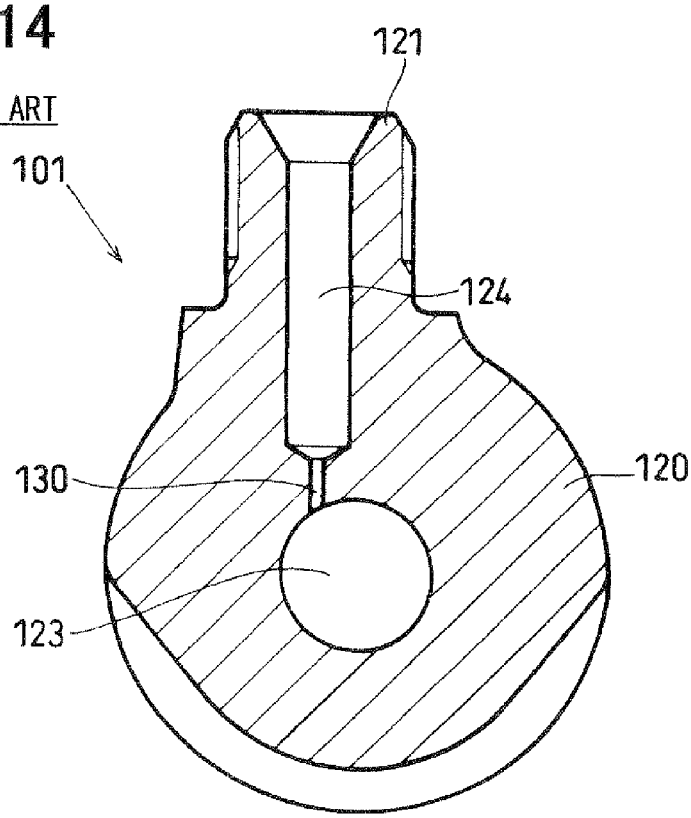
FIG. 14 RELATED ART
FIG. 14 is a sectional view showing the common rail of the related art.

The diameter of the crossing hole is small in the case where the orifice 130 for damping the pressure pulsation transmitted to the common rail 101 is integrally formed in the rail main body 120 of the common rail 101 by drilling as shown in FIG. 14. Therefore, for the purpose of ensuring the safety factor concerning fatigue strength, such the common rail 101 is used in a pressure accumulation fuel injection system of a small size vehicle or the like, in which accumulated pressure of the accumulation chamber 23 is comparatively low (for example, 180 MPa or under). However, in recent years, it has been required to increase the common rail pressure to ultra-high pressure (for example, 180 MPa or over) irrespective of the size of the vehicle in order to improve exhaust performance and the like.

The common rail 1 of the present embodiment has following features to achieve super-high accumulation pressure in the accumulation chamber 23 (for example, 180 MPa or over).

Each inside-outside communication hole 24 has a constant diameter from the outer end to the inner end or has a diameter slightly increased on the pipe joint 21 side as shown in FIG. 3. The size of the crossing hole is larger than the orifice diameter.

The bushes 31 are press-fitted to the respective inside-outside communication holes 24 formed in the rail main body 20. An orifice 30 is formed in each bush 31 for narrowing the fuel passage of the inside-outside communication hole 24. The material of the bush 31 is not limited but should have hardness suitable for the bush 31 to be press-fitted and held by the inside-outside communication hole 24. The bush 31 is made of a metal such as iron family metal, copper, brass, and aluminum.

The orifice 30 for narrowing the fuel passage of the inside-outside communication hole 24 has multiple steps (two steps in the present embodiment) on the inner peripheral surface of the bush 31. In more detail, a small-diameter orifice 32 having a small internal diameter (orifice diameter) and a large-diameter orifice 33 having an internal diameter (orifice diameter) larger than the small-diameter orifice 32 are formed in the bush 31.

The outer peripheral surface of the bush 31 defines two steps of a press-fitted portion 34 (large-diameter portion) press-fitted to the inside-outside communication hole 24 and a non-press-fitted portion 35 (small-diameter portion) having a smaller diameter than the inside-outside communication hole 24.

The small-diameter orifice 32 formed in the bush 31 and the press-fitted portion 34 are deviated from each other in an axial direction of the inside-outside communication hole 24 (i.e., in a press-fitting direction) such that the small-diameter orifice 32 and the press-fitted portion 34 do not overlap in a radial direction of the inside-outside communication hole 24. That is, the small-diameter orifice 32 is not formed on the inner periphery of the press-fitted portion 34 but is formed on the inner periphery of the non-press-fitted portion 35.

The diameter of the crossing hole is the diameter of the inside-outside communication hole 24 and is larger than the orifice diameter. Thus, the diameter of the crossing hole can be made larger than the orifice diameter and therefore the concentration of stress applied to the edge of the crossing hole can be relaxed. Thus, even if the ultra-high pressure is accumulated in the accumulation chamber 23 (for example, 180 MPa or over), the safety factor concerning the fatigue strength can be secured.

The bush 31 is tightly press-fitted into the inside-outside communication hole 24 such that the bush 31 does not drop out of the inside-outside communication hole 24 even if the bush 31 receives a pressure difference between pressure in the accumulation chamber 23 and external pressure. Therefore, there is a possibility that the internal diameter of the large-diameter orifice 33 on the inner periphery of the press-fitted portion 34 is reduced by distortion caused by the press-fitting.

The small-diameter orifice 32 is deviated from the press-fitted portion 34 in the axial direction of the inside-outside communication hole 24 to prevent the overlap between the small-diameter orifice 32 and the press-fitted portion 34.

Therefore, even if the bush 31 is tightly press-fitted to the inside-outside communication hole 24, a problem of the reduction of the internal diameter of the small-diameter orifice 32 due to the distortion caused by the press-fitting can be averted.

The bush 31 has the small-diameter orifice 32 and the large-diameter orifice 33. The internal diameter of the small-diameter orifice 32, which significantly affects the injection characteristic of the injector 2, is unchanged. Therefore, a problem of the change in the injection characteristic of the injector 2 due to the reduction in the diameter of the small-diameter orifice 32 can be avoided.

The small-diameter orifice 32 is arranged closer to the accumulation chamber 23 than the press-fitted portion 34. The pressure pulsation transmitted from each of the pipes 6, 7 is damped by two steps of the large-diameter orifice 33 and the small-diameter orifice 32. Accordingly, the damping effect of the pressure pulsation can be improved.

The bush 31 is press-fitted at a position deviated from the external thread 25 in the axial direction of the inside-outside communication hole 24 such that the bush 31 does not overlap with the external thread 25. In more detail, the inside-outside communication hole 24 includes a large-diameter hole 39 on the pipe joint 21 side. The large-diameter hole 39 has an internal diameter larger than the external diameter of the press-fitted portion 34. The inside-outside communication hole 24 includes a small-diameter hole 40 only on the deeper side than the pipe joint 21 (i.e., on the accumulation chamber 23 side). The small-diameter hole 40 has an internal diameter smaller than the external diameter of the press-fitted portion 34 by a press-fitting margin. Accordingly, the press-fitted portion 34 of the bush 31 is press-fitted only to the small-diameter hole 40 formed on the deeper side than the external thread 25.

With such the construction, even if the bush 31 is tightly press-fitted to the inside-outside communication hole 24, a problem of the deformation of the external thread 25 due to the distortion caused by the press-fitting can be averted since the inner periphery of the external thread 25 is deviated in the axial direction from a portion where the stress is produced by the press-fitted portion 34. Thus, even if the bush 31 is press-fitted into the inside-outside communication hole 24, the deformation of the external thread 25 is prevented and trouble concerning the fastening of the pipes 6, 7 is prevented.

A structure, in which the end portion of the small-diameter orifice 32 is arranged near the accumulation chamber 23, is used. By enlarging the volume of the end portion of the small-diameter orifice 32, the effect of damping the reflection of pressure pulsation can be exerted. By providing the end portion of the small-diameter orifice 32 near the accumulation chamber 23, the effect of damping the pressure pulsation reflected to the injector pipe 7 can be further improved.

Figure 4A:
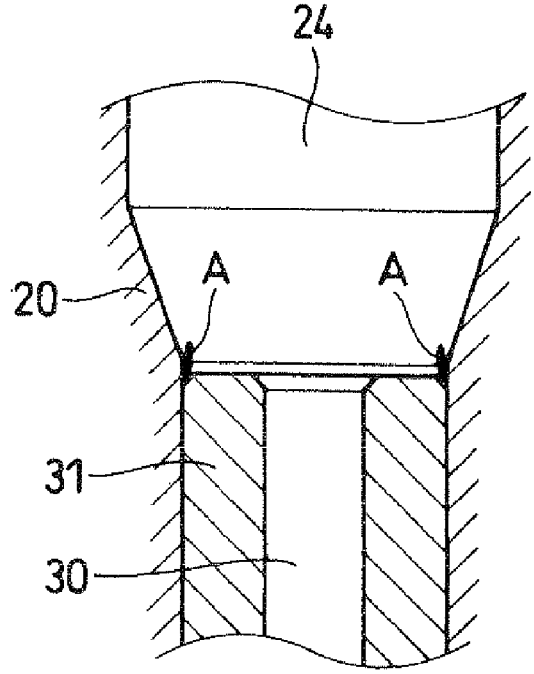
FIG. 4A RELATED ART
FIG. 4A is a sectional view showing a substantial part of a common rail of a related art.

The bush 31 is tightly press-fitted into the inside-outside communication hole 24 to prevent the bush 31 from dropping out of the inside-outside communication hole 24 even if the bush 31 receives the pressure difference between the pressure of the accumulation chamber 23 and the external pressure. Therefore, there is a possibility that a press-fitting burr A is produced at the press-fitting end portion of the bush 31 (see FIG. 4A) when the bush 31 is press-fitted to the inside-outside communication hole 24. If the engine is driven in a state where the press-fitting burr A is produced as shown in FIG. 4A, there is a possibility that the press-fitting burr A drops due to an action of the fuel flow and flows as a foreign matter to the injector 2.

Figure 4B:
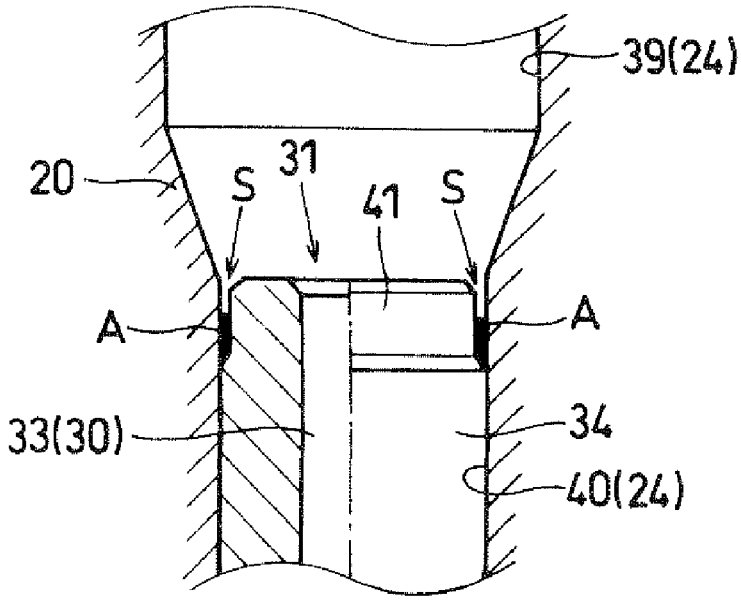
FIG. 4B is a sectional view showing a substantial part of the common rail according to the first embodiment.

To avoid the above-mentioned problem (dropout and outflow of the press-fitting burr A), in the present embodiment, as shown in FIG. 4B, a depressed portion is formed on an outer peripheral surface of a press-fitting end portion of the bush 31. Thus, an annular clearance S is formed between the outer peripheral surface of the press-fitting end portion of the bush 31 and the inner peripheral surface of the inside-outside communication hole 24 in a state where the bush 31 is press-fitted in the inside-outside communication hole 24. The annular clearance S defines a space for confining the press-fitting burr A in a portion where the action of the flow of the fuel is low.

More specifically, the bush 31 of the present embodiment has a small-diameter circular column portion 41 at the press-fitting end portion (upper side of the press-fitted portion 34 in FIG. 4B). The small-diameter circular column portion 41 has a diameter slightly smaller than the small-diameter hole 40. Thus, the narrow annular clearance S is formed between the small-diameter circular column portion 41 and the small-diameter hole 40 in a state where the bush 31 is press-fitted in the inside-outside communication hole 24.

In the present embodiment, the annular clearance S is formed by reducing the diameter of the press-fitting end portion of the bush 31. Alternatively, a depressed portion may be formed on the inside-outside communication hole 24 side by enlarging the diameter of a portion of the inside-outside communication hole 24 facing the outer peripheral surface of the press-fitting end portion of the bush 31 in a state where the bush 31 is press-fitted in the inside-outside communication hole 24. Thus, the annular clearance S is formed between the outer peripheral surface of the press-fitting end portion of the bush 31 and the inner peripheral surface of the inside-outside communication hole 24 (refer to second, fourth or fifth embodiment).

The clearance between the small-diameter circular column portion 41 and the small-diameter hole 40 is formed at a minimum size (or a size close to the minimum size) capable of receiving the press-fitting burr A which is produced when the bush 31 is press-fitted to the inside-outside communication hole 24, in the annular clearance S. For example, the clearance is formed to be approximately 0.1 mm.

The axial size of the small-diameter circular column portion 41 is set to a size capable of reducing the movement of the fuel in the depth of the annular clearance S when the engine is operating and capable of securing a necessary press-fitted length of the bush 31. For example, the axial size of the small-diameter circular column portion 41 is set to approximately 1.2 mm.

The above-mentioned sizes are mere examples and do not limit the present invention.

When the bush 31 is press-fitted to the inside-outside communication hole 24 of the rail main body 20 during the manufacturing the common rail 1, there is a possibility that a part of the outer peripheral surface of the press-fitted portion 34 of the bush 31 is scraped by the small-diameter hole 40 of the inside-outside communication hole 24 and the press-fitting burr A is produced at the press-fitting end portion of the bush 31.

As described above, the narrow annular clearance S is formed between the small-diameter circular column portion 41 and the small-diameter hole 40. Therefore, the press-fitting burr A produced at the press-fitting end portion of the bush 31 is confined in the depth of the narrow annular clearance S. Thus, even if the pressure accumulation fuel injection system is mounted in the vehicle and the fuel flows through the inside-outside communication hole during the operation of the engine, the fuel in the depth of the narrow annular clearance S stagnates and the movement thereof in the depth of the narrow annular clearance S is limited. Thus, the flow of the fuel acting on the press-fitting burr A is small. Accordingly, the dropping of the press-fitting burr A and the flowing of the press-fitting burr A to the injector 2 can be avoided.

Thus, even if the press-fitting burr A is produced at the press-fitting end portion of the bush 31, the press-fitting burr A can be confined in the narrow annular clearance S and can be prevented from dropping out. Accordingly, necessity for work of removing the press-fitting burr A and management about presence or absence of the press-fitting burr A, which require a lot of labor, can be eliminated. As a result the highly reliable common rail 1 can be provided at low cost.

Figure 5:
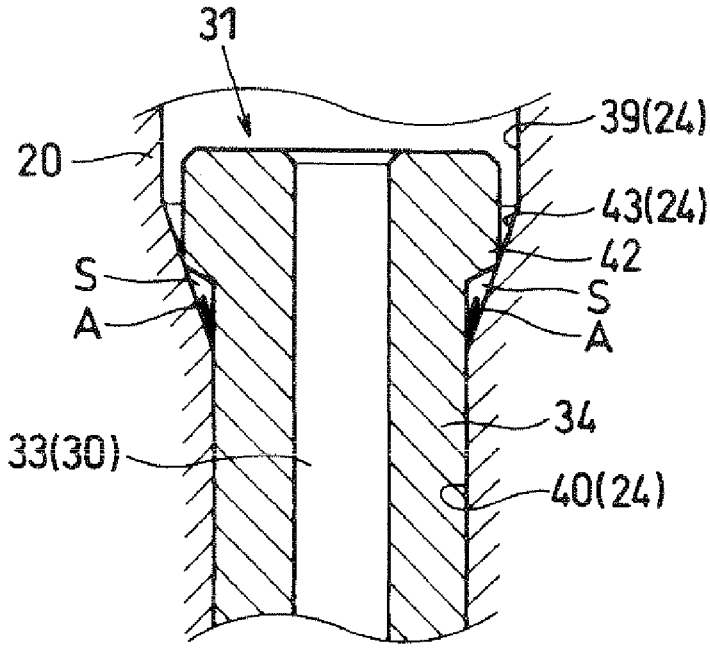
FIG. 5 is a sectional view showing a substantial part of a common rail according to a second embodiment of the present invention.

Next, a second embodiment of the present invention will be described with reference to FIG. 5. In the second embodiment, a lid portion for confining the press-fitting burr A in the annular clearance S is formed at the press-fitting end portion of the bush 31.

In more detail, in the present embodiment, a circular column head portion 42 (corresponding to the lid portion in the present embodiment) is formed at the press-fitting end portion of the bush 31. The diameter of the circular column head portion 42 is larger than the small-diameter hole 40 and smaller than the large-diameter hole 39. The bush 31 is press-fitted until the circular column head portion 42 strikes against a tapered portion 43 (an example of the depressed portion forming the annular clearance S), which is a transient portion between the large-diameter hole 39 and the small-diameter hole 40 and is formed substantially in the shape of a circular conical surface.

Thus, the annular clearance S for confining the press-fitting burr A is formed between the tapered potion 43 of the inside-outside communication hole 24 and the bush 31. The circular column head portion 42 strikes against the tapered portion 43 to completely block the annular clearance S.

Since the circular column head portion 42 is formed in such the manner, even if the press-fitting burr A produced during the press-fitting drops out, the dropped press-fitting burr A is confined in the annular clearance S by the circular column head portion 42. Therefore, the dropped press-fitting burr A is prevented from flowing out to the injector 2.

Figure 6:
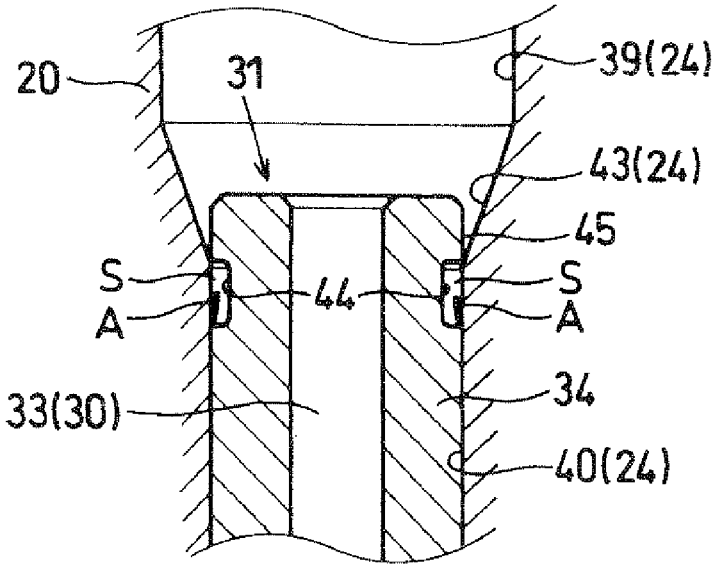
FIG. 6 is a sectional view showing a substantial part of a common rail according to a third embodiment of the present invention.

Next, a third embodiment of the present invention will be described with reference to FIG. 6. In the third embodiment, like the second embodiment, a lid portion for confining the press-fitting burr A in the annular clearance S is formed at the press-fitting end portion of the bush 31.

In more detail, in the present embodiment, a burr confining groove 44 for confining the press-fitting burr A in the annular clearance S is formed at the press-fitting end portion of the bush 31. A bush head portion 45 above the burr confining groove 44 in FIG. 6 corresponds to the lid portion in the present embodiment. The bush 31 is press-fitted until shortly before the bush head portion 45 is press-fitted to the small-diameter hole 40. The bush head portion 45 may be press-fitted to the small-diameter hole 40 to a small extent.

Also with such the construction, the annular clearance S for confining the press-fitting burr A is formed between the small-diameter hole 40 of the inside-outside communication hole 24 and the burr confining groove 44 of the bush 31 and the bush head portion 45 blocks the annular clearance S. Thus, like the second embodiment, even if the press-fitting burr A produced in the press-fitting drops out, the dropped press-fitting burr A is confined in the annular clearance S by the bush head portion 45 and therefore the dropped press-fitting burr A is prevented from flowing out to the injector 2.

Figure 7:
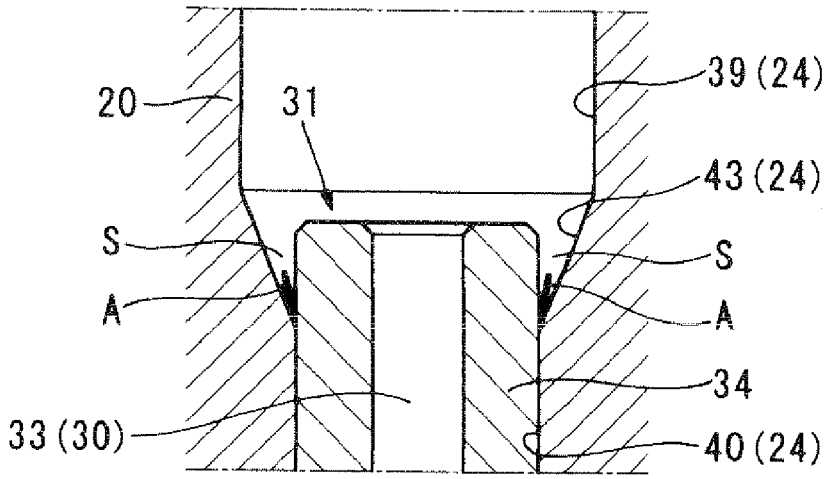
FIG. 7 is a sectional view showing a substantial part of a common rail according to a fourth embodiment of the present invention.

Next, a fourth embodiment of the present invention will be described with reference to FIG. 7. In the fourth embodiment, the circular column head portion 42 (lid portion) of the second embodiment is eliminated.

That is, the inside-outside communication hole 24 of the present embodiment includes a large-diameter hole 39 that is provided on the outer side (upper side in FIG. 7) and that has a diameter larger than a press-fitted external diameter of the bush 31, a small-diameter hole 40 that is provided on the inner side (lower side in FIG. 7) and that is press-fitted with the bush 31, and a tapered portion 43 that is provided at a transient portion between the large-diameter hole 39 and the small-diameter hole 40 and that has a gradually reducing internal diameter. The annular clearance S for confining the press-fitting burr A is formed between the outer peripheral surface of the end portion of the bush 31 opposite to the press-fitting direction (i.e., an outer peripheral surface of a portion of the bush 31 not press-fitted to the small-diameter hole 40) and the tapered portion 43 as shown in FIG. 7 in a state where the bush 31 is press-fitted in the inside-outside communication hole 24.

Thus, even if the circular column head portion 42 (lid portion) according to the second embodiment is not formed, an effect similar to that of the first embodiment can be exerted.

Figure 8:
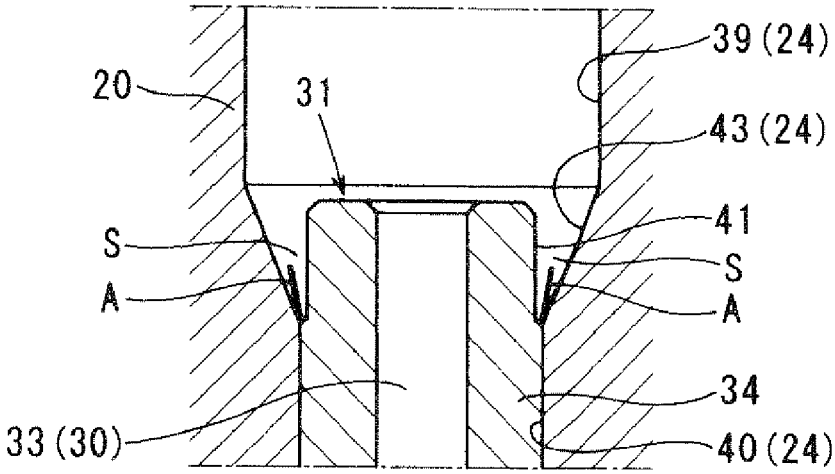
FIG. 8 is a sectional view showing a substantial part of a common rail according to a fifth embodiment of the present invention.

Next, a fifth embodiment of the present invention will be described with reference to FIG. 8. The fifth embodiment is a combination of the first embodiment and the fourth embodiment.

That is, the bush 31 of the present embodiment has a small-diameter circular column portion 41 that has a diameter smaller than an external diameter of the press-fitted portion 34 of the bush 31 and that is formed on an outer peripheral surface of an end portion of the bush 31 opposite to the press-fitting direction (i.e., upper side of the bush 31 in FIG. 8) like the first embodiment. Like the second or fourth embodiment, the inside-outside communication hole 24 has a large-diameter hole 39 that has a diameter larger than the diameter of the press-fitted portion 34 of the bush 31 and that is formed on the outer side (upper side in FIG. 8), a small-diameter hole 40 that is formed on the inner side and is press-fitted with the bush 31 and a tapered portion 43 that is formed at a transient portion between the large-diameter hole 39 and the small-diameter hole 40 and has a gradually reducing internal diameter. The annular clearance S for confining the press-fitting burr A is formed between the small-diameter circular column portion 41 and the tapered portion 43 in a state where the bush 31 is press-fitted in the inside-outside communication hole 24.

Thus, even in the case where the annular clearance S for confining the press-fitting burr A is formed between the tapered portion 43 and the small-diameter circular column portion 41, an effect similar to that of the first embodiment can be exerted.

Figure 9:
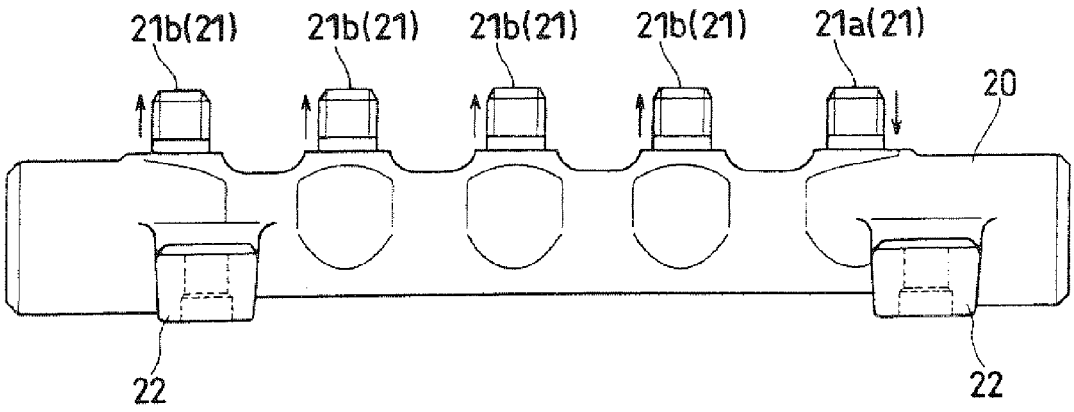
FIG. 9 is a side view showing a common rail according to a sixth embodiment of the present invention.

Next, a sixth embodiment of the present invention will be described with reference to FIGS. 9 to 10B. Like the first embodiment, the multiple pipe joints 21 to be connected with the high-pressure pump pipe 6 and the injector pipes 7 are fixed to the rail main body 20 of the common rail 1. In the following description of the sixth embodiment, the pipe joint 21 connected with the high-pressure pipe 6 will be referred to as an in-joint 21*a* and the pipe joints 21 connected with the injector pipes 7 will be referred to as out-joints 21*b*.

In an example of FIG. 1 showing the first embodiment, out of the five pipe joints 21, the central pipe joint 21 is the in-joint 21*a* and the four pipe joints on the both sides are the out-joints 21*b*. The positions of the in-joint 21*a* and the out-joints 21*b* can differ according to the layout of the pipes and the like. For example, in FIG. 9, out of the five pipe joints 21, the pipe joint 21 on the right end is the in-joint 21*a* and the other four pipe joints 21 arranged on the left side are the out-joints 21*b*.

The bush 31 reduces the pressure pulsation with the orifice 30 as described above. The pressure pulsation caused in the pipe joint 21 by the discharge operation of the high-pressure pump pipe 6 is different from the pressure pulsation caused in the injection pipe 7 by the injection operation of the injector 2.

Therefore, in the present embodiment, a bush 31 (shown in FIG. 10B and referred to as an in-bush 31*a* hereinafter) having an orifice diameter suitable for reducing the pressure pulsation caused by the discharge operation of the high-pressure pump pipe 6 is press-fitted to the in-joint 21*a*. Another bush 31 (shown in FIG. 10A and referred to as an out-bush 31*b* hereinafter) having an orifice diameter suitable for reducing the pressure pulsation caused by the injection operation of the injector 2 is press-fitted to the out-joint 21*b*.

The small-diameter circular column portion 41 may be formed only in the in-bush 31*a* without forming the small-diameter circular column portion 41 in the out-bush 31*b*. Alternatively, the small-diameter circular column portion 41 may be formed only in the out-bush 31*b* without forming the small-diameter circular column portion 41 in the in-bush 31*a*. Alternatively, the small-diameter circular column portions 41 may be formed in both of the in-bush 31*a* and the out-bush 31*b*.

In the present embodiment, the small-diameter circular column portion 41 is formed in either one of the in-bush 31*a* and the out-bush 31*b*. Thus, discrimination between the in-bush 31*a* and the out-bush 31*b* is enabled based on the presence or absence of the small-diameter circular column portion 41 in the bush 31.

Figure 10A:
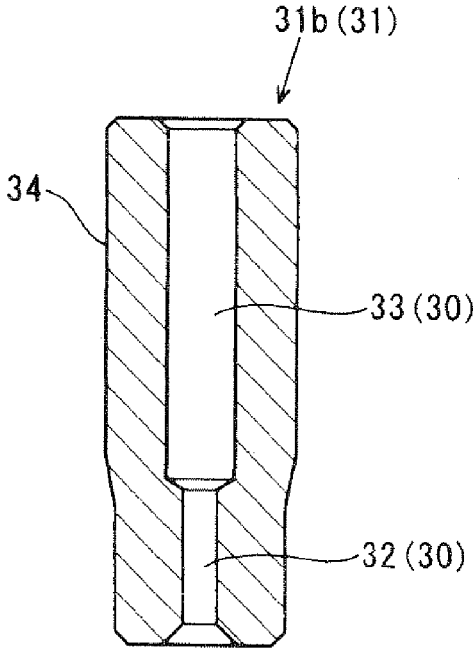
FIGS. 10A and 10B are sectional views showing bushes according to the sixth embodiment.
Figure 10B:
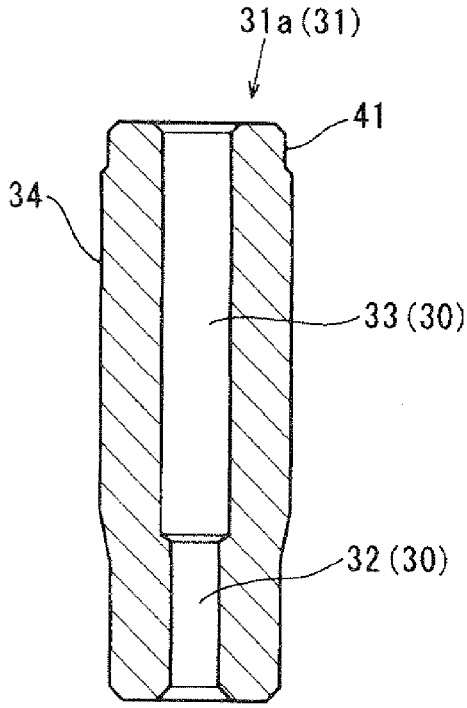

In an example, the small-diameter circular column portion 41 is not formed in the out-bush 31*b* as shown in FIG. 10A but is formed only in the in-bush 31*a* as shown in FIG. 10B. Thus, whether the bush 31 is the in-bush 31*a* or the out-bush 31*b* can be determined by the appearance of the bush 31. That is, the discrimination between the in-bush 31*a* and the out-bush 31*b* in the manufacture process can be made by the appearance of the bush 31 and the faulty assembling of the in-bush 31*a* and the out-bush 31*b* can be prevented.

In the present embodiment, the example of making the discrimination between the in-bush 31*a* and the out-bush 31*b* by using the small-diameter circular column portion 41 formed in the bush 31 is used. Alternatively, the discrimination between the in-bush 31*a* and the out-bush 31*b* may be made by using, for example, the circular column head portion 42 (lid portion) of the second embodiment or the burr confining groove 44 of the third embodiment.

Figure 11:
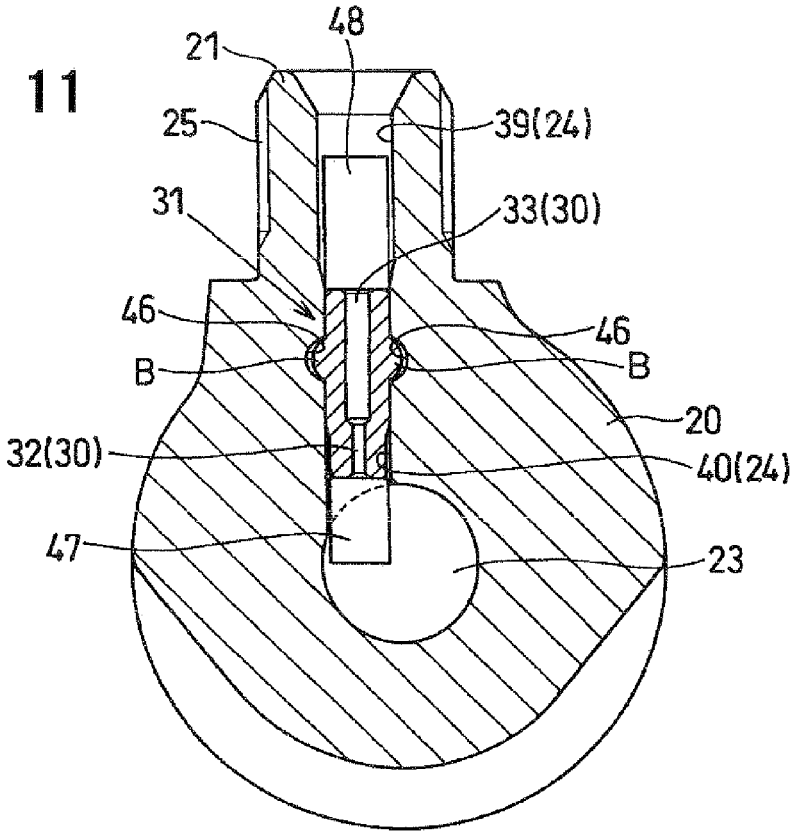
FIG. 11 is a sectional view showing a substantial part of a common rail according to a seventh embodiment of the present invention.

Next, a seventh embodiment of the present invention will be described with reference to FIG. 11.

The first to sixth embodiments are described as examples of press-fitting the bush 31 into the inside-outside communication hole 24 and confining the press-fitting burr A produced during the press-fitting in the annular clearance S.

The present embodiment and subsequent embodiments are described as examples of plastically deforming the bush 31 in a state where the bush 31 is inserted in the inside-outside communication hole 24, thereby fixing the bush 31 in the inside-outside communication hole 24.

The rail main body 20 according to the present embodiment has a depressed portion 46 in the middle of the inside-outside communication hole 24 (within a range where the bush 31 is fixed). The external diameter of the bush 31 before being fixed in the inside-outside communication hole 24 is set slightly smaller than a diameter of a portion of the inside-outside communication hole 24 (specifically, the diameter of the small-diameter hole 40) where the bush 31 is mounted.

The bush 31 is inserted in the inside-outside communication hole 24 and is pinched and pressed in the axial direction of the inside-outside communication hole 24 with two pressing jigs (an inside punch 47 inserted into the accumulation chamber 23 and an outside punch 48 inserted into the inside-outside communication hole 24 from the outside). Thus, a portion of the outer peripheral middle portion of the bush 31 is plastically deformed such that the portion bulges into the depressed portion 46. The plastically deformed portion B of the bush 31 bulged by the plastic deformation bites into the depressed portion 46, thereby fixing the bush 31 in the inside-outside communication hole 24. One of the inside punch 47 and the outside punch 48 may be fixed and a pressing force may be applied by the other one of the inside punch 47 and the outside punch 48. Alternatively, the pressing force may be applied by both of the inside punch 47 and the outside punch 48.

The depressed portion 46 is formed in a portion of the middle portion of the small-diameter hole 40. The depressed portion 46 may be an annular groove or multiple depressions. In the case where the depressed portion 46 is the annular groove, one groove may be formed or two or more grooves may be arranged in the axial direction to increase a fixing force.

Thus, in the present embodiment, a portion (a middle portion of the outer periphery) of the bush 31 is plastically deformed in a state where the bush 31 is inserted in the inside-outside communication hole 24 to fix the bush 31 in the inside-outside communication hole 24. Accordingly the press-fitting burr A is not produced at the bush 31. Therefore, the present embodiment can eliminate the necessity for the work of removing the press-fitting burr A and the management of the presence or absence of the press-fitting burr A, which require a lot of labor, like the first to sixth embodiments. As a result, the highly reliable common rail 1 can be provided at low cost.

Next, an eighth embodiment of the present invention will be described with reference to FIG. 12. The inside-outside communication hole 24 of the present embodiment has the small-diameter hole 40, in which the bush 31 is inserted, and the large-diameter hole 39 formed on an outer side (upper side in FIG. 12) of the small-diameter hole 40 with regard to the axial direction of the inside-outside communication hole 24 like the first embodiment.

The bush 31 has a large-diameter portion 51 that is provided on one axial side and that has a diameter larger than the small-diameter hole 40 and a plastically deformed portion B that is formed on the other axial side. The diameter of the plastically deformed portion B is made larger than the diameter of the small-diameter hole 40 by plastic deformation. In more detail, in the present embodiment, the large-diameter portion 51 is formed at the lower end of the bush 31 in FIG. 12 and the plastically deformed portion B is formed at the upper end of the bush 31 in FIG. 12. A stepped shape of the large-diameter portion 51 is formed to be matched to a shape around the opening of the inside-outside communication hole 24 at the accumulation chamber 23.

Figure 12:
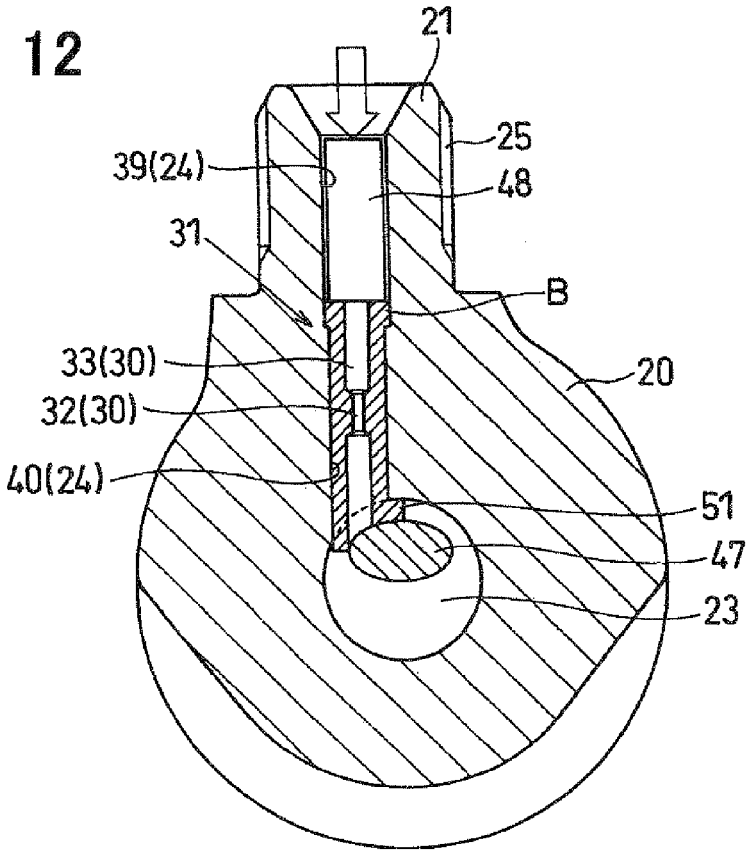
FIG. 12 is a sectional view showing a substantial part of a common rail according to an eighth embodiment of the present invention.

In a state where the large-diameter portion 51 is engaged with the portion around the opening of the inside-outside communication hole 24 in the accumulation chamber 23, the lower end of the bush 31 in FIG. 12 is fixed by an inside punch 47 inserted in the accumulation chamber 23 and the upper end of the bush 31 in FIG. 12 is pressed by an outside punch 48 inserted in the inside-outside communication hole 24 from the outside. Thus, the upper end of the bush 31 in FIG. 12 is plastically deformed to enlarge the diameter thereof. The plastically deformed portion B, the diameter of which is enlarged by the plastic deformation, is engaged with the step between the small-diameter hole 40 and the large-diameter hole 39. Thus, the bush 31 is fixed in the inside-outside communication hole 24.

Thus, a portion (the upper portion in FIG. 12) of the bush 31 is plastically deformed in a state where the bush 31 is inserted in the inside-outside communication hole 24 to fix the bush 31 in the inside-outside communication hole 24. Therefore, the press-fitting burr A is not produced at the bush 31. For this reason, the necessity for the work of removing the press-fitting burr A and the management of the presence or absence of the press-fitting burr A, which require a lot of labor, is eliminated like the seventh embodiment. As a result, the highly reliable common rail 1 can be provided at low cost.

Next, a ninth embodiment of the present invention will be described with reference to FIG. 13. The eighth embodiment is described as the example of plastically deforming the upper end of the bush 31 in FIG. 12 to fix the bush 31 in the inside-outside communication hole 24. In the ninth embodiment, the lower end (accumulation chamber 23 side end) of the bush 31 in FIG. 13 is plastically deformed to fix the bush 31 in the inside-outside communication hole 24.

Figure 13:
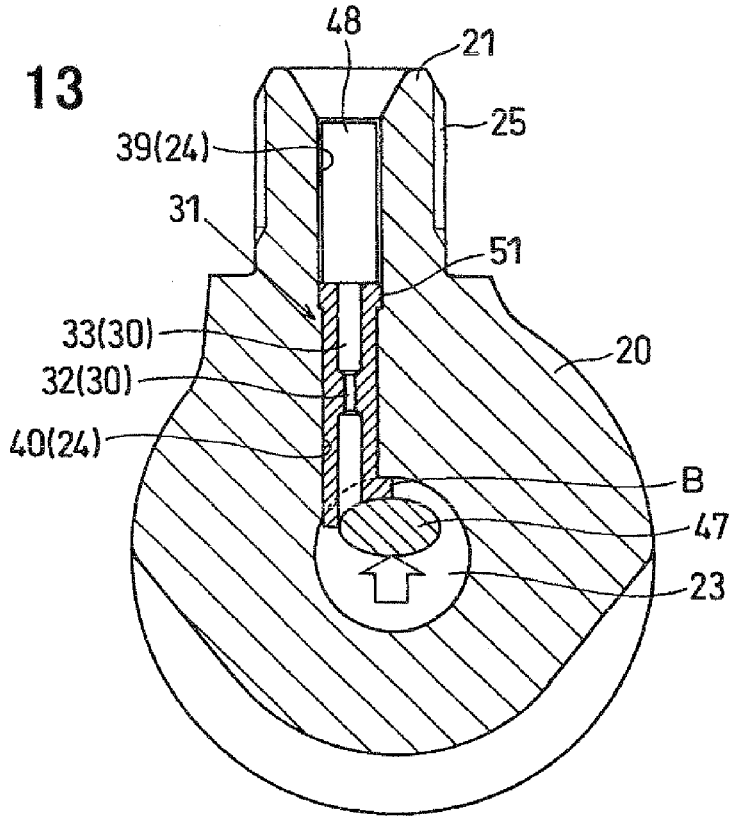
FIG. 13 is a sectional view showing a substantial part of a common rail according to a ninth embodiment of the present invention.

In detail, in the ninth embodiment, the large-diameter portion 51 is formed at the upper end of the bush 31 in FIG. 13 and the plastically deformed portion B is formed at the lower end of the bush 31 in FIG. 13.

In a state where the large-diameter portion 51 is engaged with the step between the small-diameter hole 40 and the large-diameter hole 39, the upper end of the bush 31 in FIG. 13 is fixed with an outside punch 48 inserted in the inside-outside communication hole 24 from the outside and the lower end of the bush 31 in FIG. 13 is pressed by the inside punch 47 inserted in the accumulation chamber 23. Thus, the lower end of the bush 31 in FIG. 13 is plastically deformed to enlarge the diameter thereof. The plastically deformed portion B, the diameter of which is enlarged by the plastic deformation, is engaged with a portion around the opening of the inside-outside communication hole 24 in the accumulation chamber 23. Thus, the bush 31 is fixed in the inside-outside communication hole 24.

In this manner, a portion (the lower portion in FIG. 13) of the bush 31 is plastically deformed in a state where the bush 31 is inserted in the inside-outside communication hole 24 to fix the bush 31 in the inside-outside communication hole 24. Therefore, the press-fitting burr A is not produced at the bush 31. For this reason, like the seventh and eighth embodiments, the necessity for the work of removing the press-fitting burr A and the management of the presence or absence of the press-fitting burr A, which require a lot of labor, is eliminated. As a result, the highly reliable common rail 1 can be provided at low cost.

The above embodiments are described as the examples of fixing the bushes 31 in the inside-outside communication holes 24 in the pipe joints 21, to which the pipes 6, 7 are fastened. That is, in the above-described embodiments, the present invention is applied to both (fuel inflow side and fuel outflow side) of the inside-outside communication holes 24 connected with the pipes 6, 7 respectively. Alternatively, the present invention may be applied only to the inside-outside communication hole 24 (fuel inflow side) connected with the high-pressure pump pipe 6 or only to the inside-outside communication hole 24 (fuel outflow side) connected with the injector pipe 7.

In the above-mentioned embodiments, the bush 31 is fixed such that the bush 31 is deviated from the external thread 25 in the axial direction. Alternatively, the bush 31 may be fixed such that the bush 31 overlaps with the external thread 25 in the radial direction.

In the above-mentioned embodiments, the forged common rail 1 having the rail main body 20, the pipe joints 21, and the stays 22 formed by forging is employed. Alternatively, a joined common rail 1, in which a part or all of the rail main body 20, the pipe joints 21, and the stays 22 are formed independently and are integrated into one body by a joining technology such as welding, may be used.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

What is claimed is:

1. A common rail comprising:

an accumulation chamber that accumulates high-pressure fuel therein;

an inside-outside communication hole that connects the accumulation chamber with an outside;

a bush that is press-fitted into the inside-outside communication hole and that has an orifice for narrowing a fuel passage of the inside-outside communication hole;

a depressed portion formed on at least one of an outer peripheral surface of an end portion of the bush opposite to a press-fitting direction of the bush and an inner peripheral surface of the inside-outside communication hole, which faces the outer peripheral surface of the end portion of the bush opposite to the press-fitting direction of the bush in a state where the bush is press-fitted in the inside-outside communication hole; and a clearance formed between the outer peripheral surface of the end portion of the bush opposite to the press-fitting direction of the bush and the inner peripheral surface of the inside-outside communication hole in the state where the bush is press-fitted in the inside-outside communication hole.

2. The common rail as in claim 1, wherein the bush has a small-diameter circular column portion that is formed on the outer peripheral surface of the end portion of the bush opposite to the press-fitting direction of the bush and that has a diameter smaller than an external diameter of a press-fitted portion of the bush, at which the bush is press-fitted to the inside-outside communication hole; and the clearance is formed in an annular shape between the small-diameter circular column portion and the inside-outside communication hole in the state where the bush is press-fitted in the inside-outside communication hole.

3. The common rail as in claim 1, wherein the inside-outside communication hole has a large-diameter hole that is provided on an outer side and that has a diameter larger than an external diameter of a press-fitted portion of the bush at which the bush is press-fitted to the inside-outside communication holes a small-diameter hole that is provided on an inner side and that is press-fitted with the bush, and a tapered portion that is provided at a transient portion between the large-diameter hole and the small-diameter hole and that has a gradually-reducing internal diameter, and the clearance is formed in an annular shape between the outer peripheral surface of the end portion of the bush opposite to the press-fitting direction of the bush and the tapered portion in the state where the bush is press-fitted in the inside-outside communication hole.

4. The common rail as in claim 1, wherein the bush has a small-diameter circular column portion that is provided on the outer peripheral surface of the end portion of the bush opposite to the press-fitting direction of the bush and that has a diameter smaller than an external diameter of a press-fitted portion of the bush at which the bush is press-fitted to the inside-outside communication hole, the inside-outside communication hole has a large-diameter hole that is provided on an outer side and that has a diameter larger than the external diameter of the press-fitted portion of the bush, a small-diameter hole that is provided on an inner side and that is press-fitted with the bush, and a tapered portion that is provided at a transient portion between the large-diameter hole and the small-diameter hole and that has a gradually-reducing internal diameter, and the clearance is formed in an annular shape between the small-diameter circular column portion and the tapered portion in the state where the bush is press-fitted in the inside-outside communication hole.

5. The common rail as in claim 1, wherein the bush has a lid portion provided to the end portion of the bush opposite to the press-fitting direction of the bush for confining a burr in the clearance.

6. A common rail comprising:

an accumulation chamber that accumulates high-pressure fuel therein;

an inside-outside communication hole that connects the accumulation chamber with an outside; and a bush that is fixed in the inside-outside communication hole and that has an orifice for narrowing a fuel passage of the inside-outside communication hole, wherein the bush is plastically deformed in a state where the bush is inserted in the inside-outside communication hole, thereby fixing the bush in the inside-outside communication hole.

7. The common rail as in claim 6, wherein the inside-outside communication hole has a depressed portion, and the bush is pressed in an axial direction inside the inside-outside communication hole such that the bush is plastically deformed and bulged into the depressed portion, thereby fixing the bush in the inside-outside communication hole.

8. The common rail as in claim 6, wherein the inside-outside communication hole has a small-diameter hole, in which the bush is inserted and arranged, and a large-diameter hole formed axially outside the small-diameter hole, the bush has a large-diameter portion at one axial end and a plastically deformed portion at the other axial end, the plastically deformed portion having a diameter enlarged by the plastic deformation performed in the state where the bush is inserted in the inside-outside communication hole, and one of the large-diameter portion and the plastically deformed portion is engaged with a portion around an opening of the inside-outside communication hole in the accumulation chamber and the other one of the large-diameter portion and the plastically deformed portion is engaged with a step formed between the small-diameter hole and the large diameter hole, thereby fixing the bush in the inside-outside communication hole.

9. A manufacturing method of a common rail having an accumulation chamber that accumulates high-pressure fuel therein, an inside-outside communication hole that connects the accumulation chamber with an outside, and a bush that is fixed in the inside-outside communication hole and that has an orifice for narrowing a fuel passage of the inside-outside communication hole, the manufacturing method comprising:

inserting the bush in the inside-outside communication hole, and deforming the bush plastically to fix the bush in the inside-outside communication hole.

10. The manufacturing method as in claim 9, further comprising:

pressing the bush in an axial direction inside the inside-outside communication hole such that the bush is plastically deformed and bulged into a depressed portion provided in an inner periphery of the inside-outside communication hole.

11. The manufacturing method as in claim 9, further comprising:

engaging one of a large-diameter portion, which is provided to one axial end of the bush, and a plastically deformed portion, which is provided to the other axial end of the bush and which has a diameter enlarged by the deforming, with a portion around an opening of the inside-outside communication hole in an accumulation chamber of the common rail; and engaging the other one of the large-diameter portion and the plastically deformed portion with a step formed between a small-diameter hole and a large diameter hole of the inside-outside communication hole.

* * * * *